US008236746B2

(12) United States Patent
Yanagisawa et al.

(10) Patent No.: US 8,236,746 B2
(45) Date of Patent: Aug. 7, 2012

(54) DETERGENT COMPOSITION COMPRISING A TERNARY SURFACTANT MIXTURE AND A CLAY

(75) Inventors: Yuki Yanagisawa, Wakayama (JP); Kuniaki Mitsuyoshi, Wakayama (JP); Wataru Ueno, Wakayama (JP); Isao Yamada, Wakayama (JP); Teruo Kubota, Wakayama (JP)

(73) Assignee: Kao Corporation, Tokyo (JP)

( * ) Notice: Subject to any disclaimer, the term of this patent is extended or adjusted under 35 U.S.C. 154(b) by 206 days.

(21) Appl. No.: 12/525,471

(22) PCT Filed: Jan. 30, 2008

(86) PCT No.: PCT/JP2008/051351

§ 371 (c)(1),
(2), (4) Date: Jul. 31, 2009

(87) PCT Pub. No.: WO2008/093696

PCT Pub. Date: Aug. 7, 2008

(65) Prior Publication Data

US 2010/0041578 A1 Feb. 18, 2010

(30) Foreign Application Priority Data

Feb. 1, 2007 (JP) ..... 2007-023153

(51) Int. Cl.
*C11D 1/86* (2006.01)
*C11D 3/08* (2006.01)

(52) U.S. Cl. ..... 510/334; 510/276; 510/340; 510/341; 510/351; 510/356; 510/357; 510/421; 510/422; 510/426; 510/427; 510/507

(58) Field of Classification Search ..... 510/276, 510/334, 340, 341, 351, 356, 357, 421, 422, 510/426, 427, 507
See application file for complete search history.

(56) References Cited

U.S. PATENT DOCUMENTS

| | | | | |
|---|---|---|---|---|
| 3,962,100 | A * | 6/1976 | Murphy et al. | 510/333 |
| 4,166,039 | A * | 8/1979 | Wise | 510/453 |
| 4,663,071 | A | 5/1987 | Bush et al. | |
| 4,687,592 | A | 8/1987 | Collins et al. | |
| 4,689,167 | A | 8/1987 | Collins et al. | |
| 4,721,580 | A * | 1/1988 | Gosselink | 510/297 |
| 4,844,821 | A * | 7/1989 | Mermelstein et al. | 510/328 |
| 4,844,824 | A * | 7/1989 | Mermelstein et al. | 510/321 |
| 5,500,151 | A * | 3/1996 | Cao et al. | 510/321 |
| 5,627,151 | A | 5/1997 | Detering et al. | |
| 5,846,924 | A * | 12/1998 | Detering et al. | 510/475 |
| 6,133,227 | A * | 10/2000 | Barnabas et al. | 510/530 |
| 7,094,734 | B2 * | 8/2006 | Ushiguchi et al. | 504/206 |
| 2001/0011068 | A1 | 8/2001 | Bird et al. | |
| 2002/0004476 | A1 * | 1/2002 | Pancheri et al. | 510/509 |
| 2003/0163877 | A1 * | 9/2003 | Baker et al. | 8/405 |
| 2003/0203466 | A1 * | 10/2003 | Kauppinen et al. | 435/200 |
| 2004/0110652 | A1 * | 6/2004 | Hafkamp et al. | 510/130 |
| 2004/0152617 | A1 * | 8/2004 | Murphy et al. | 510/475 |
| 2005/0065056 | A1 * | 3/2005 | Cook et al. | 510/438 |
| 2007/0072785 | A1 * | 3/2007 | Sahin Topkara et al. | 510/296 |
| 2007/0149423 | A1 * | 6/2007 | Warr et al. | 510/101 |
| 2008/0032910 | A1 * | 2/2008 | Smets et al. | 510/342 |
| 2009/0170746 | A1 * | 7/2009 | Kubota et al. | 510/334 |

FOREIGN PATENT DOCUMENTS

| | | | |
|---|---|---|---|
| JP | 56-167798 | A | 12/1981 |
| JP | 62-253694 | A | 11/1987 |
| JP | 8-502773 | A | 3/1996 |
| JP | 8-510278 | A | 10/1996 |
| JP | 9-87691 | A | 3/1997 |
| JP | 10-331067 | A | 12/1998 |
| JP | 2001-131587 | A | 5/2001 |
| JP | 2005-120162 | A | 5/2005 |
| JP | 2005-187998 | A | 7/2005 |
| JP | 2006-219554 | A | 8/2006 |
| JP | 2007/015440 | A1 | 2/2007 |
| JP | 2007/077813 | A1 | 7/2007 |
| WO | WO 01/44425 | A1 | 6/2001 |
| WO | 1 967 575 | A1 | 9/2008 |

OTHER PUBLICATIONS

International Search Report issued in corresponding PCT/JP2008/051351 dated Apr. 22, 2008.
European Search Report issued Jul. 14, 2010, in corresponding European Patent Application No. 08704133.1.
Office Action issued Dec. 28, 2010, in Chinese Patent Application No. 200880003731.4, with English translation.

* cited by examiner

*Primary Examiner* — Charles Boyer
(74) *Attorney, Agent, or Firm* — Birch, Stewart, Kolasch & Birch, LLP

(57) ABSTRACT

A detergent composition containing:
(a) a nonionic surfactant containing a polyoxyalkylene alkyl ether of which alkylene oxide moiety has an average number of moles of from 4 to 8;
(b) an anionic surfactant, excluding a fatty acid and a salt thereof; and
(c) a clay mineral represented by the general formula (I):

$$[Si_8(Mg_aAl_b)O_{20}(OH)_4]^{X-}\cdot Me^{X+} \quad (I)$$

wherein a, b and x satisfy $0<a\leqq 6$, $0<b\leqq 4$, and $x=12-2a-3b$, and Me is at least one member selected from Na, K, Li, Ca, Mg and $NH_4$, wherein the clay mineral is contained in an amount of 3% by weight or more,
wherein a weight ratio of the component (a) to the component (b), (a)/(b), exceeds 1 and is less than 5.

14 Claims, No Drawings

DETERGENT COMPOSITION COMPRISING A TERNARY SURFACTANT MIXTURE AND A CLAY

TECHNICAL FIELD

The present invention relates to a detergent composition and a powder detergent composition.

BACKGROUND ART

In recent years, a water-saving type washing machine, i.e. a washing machine of which amount of water used for washing is small, has become widespread, from an increasing awareness of environmental issues, or the like. A marked example thereof is a washing machine generally so-called "high efficiency-type washer, drum-type front-load washer in Japanese," which has been broadly accepted worldwide. However, this washing system in which a smaller amount of water is used against a washing item has a disadvantage that a washing item is gradually looking gray by performing washing. The reduction in a washing water is preferable from the viewpoint of reduction of loads on environmental issues by conservation of energy, economic advantages, and the like. However, one of the main causations of the "gray-looking" of a washing item is the small amount of the used water as mentioned below; therefore, improvements by the washing machine itself have been a difficult disadvantage. Therefore, at present with the progress in the widespread use of a water-saving type washing machine, a detergent composition not only exhibiting high detergency but also being capable of controlling the gray-looking of a washing item, even in a washing system with a smaller amount of water used as described above has been earnestly desired.

A typical phenomenon of gradual gray-looking of a washing item by every wash includes a phenomenon wherein colored components such as soils that are detached from a washing item during the washing process are redeposited to the washing item in a washing water again. When the amount of the washing water becomes smaller, the soil concentration in the washing water increases, so that such soils are more likely to be redeposited. Even in a case where a concentration of a detergent or a dispersant, such as a surfactant, as well as soils, increases in a washing liquid by reducing the amount of water, a negative effect caused by an increase in the soil concentration in water is greater than a positive effect of preventing redeposition by these components; therefore, a phenomenon of causing acceleration of the soil redeposition to the washing item can also be confirmed.

In addition, among the soils in a washing liquid, representative examples of colored components are fine hydrophilic particles such as those contained in sludge, and fine hydrophobic particles such as soot. In order to prevent gray-looking, a detergent composition having high deposition preventing ability against soil particles having different physical properties from those mentioned above is required.

Conventionally, as a technique of preventing redeposition, as described in Patent Publication 1, one having an improved dispersibility of soils in a washing liquid with a dispersant such as a polymer has been known.

In addition, a technique based on a mechanism different from that of above is such that the physical properties of the surfaces of the fibers are modified by adsorbing a specified chemical species to fibers, and whereby the redeposition of the soils are prevented. For example, Patent Publication 2 describes that the redeposition preventing ability of soils is improved by depositing a smectite-type clay mineral to the fibers. However, in the case of Patent Publication 2, in a mechanism for preventing redeposition such as one exhibiting the effect by deposition of the chemical species, a mechanism of stably dispersing soil particles in a washing liquid is not suggested, so that any effects in a case where deposition to fibers of the chemical species is undesired are hardly exhibited. Particularly, a surfactant, which is a technique concerning dispersion systems, especially a nonionic surfactant, is not suggested, so that redeposition preventing ability of fine hydrophobic particles such as soot, that is considered to be an important factor for preventing gray-looking, is not sufficient. In addition, in this mechanism, the repetition of washes is a necessary condition for exhibiting the effect, so that it is not sufficient to prevent gray-looking in a high-soil concentration liquid mixture such as one in which gray-looking is recognized even in a single cycle of wash.

In addition, a technique utilizing a smectite-type clay mineral, as described in Patent Publication 3, includes an example using a clay mineral in order to improve the physical properties of granules of a detergent composition containing a nonionic surfactant. However, in the case of Patent Publication 3, since there is no technical idea of preventing gray-looking of a washing item, the content of an anionic surfactant is not sufficient, so that the redeposition preventing ability of fine hydrophilic particles such as sludge particles, one of the causations of the gray-looking, is not sufficient.

A technique of soil preventing treatment of laundry in the step of washing the laundry with a washing machine by applying an amphoteric polymer having a cationic group and an anionic group to a laundry detergent composition has been known (Patent Publication 4). However, while a detergent effect for sebum soils during washing is high, redeposition preventing ability of fine hydrophilic particles as those contained in sludge and fine hydrophobic particles such as soot by the soils in a washing liquid is not sufficient.

Therefore, in any of these techniques, it is not sufficient to prevent the redeposition of the soils in a washing water with a drastically increased soil concentration by making the amount of the washing water small.

Patent Publication 1: JP-A-Showa-62-253694
Patent Publication 2: JP-A-Showa-56-167798
Patent Publication 3: JP-B-3043976
Patent Publication 4: JP-B-3405941

DISCLOSURE OF INVENTION

Problems to be Solved by the Invention

Focusing on the above matters, an object of the present invention is to provide a detergent composition exhibiting a sufficient effect of preventing redeposition of soils, in order to prevent gray-looking of a washing item in washing performed in households, especially under washing conditions that the soil redeposition is accelerated because the water is used in a small amount.

Means to Solve the Problems

As a result of intensive studies in view of the need of preventing redeposition of soils in a washing liquid, the present inventors have found that the redeposition to the washing item can be effectively prevented for various soils by a new mechanism that the soil particles are merely stably dispersed in a washing liquid, and but also it is not solely caused by surface modification of a washing item by adsorption residues on cloths of a clay mineral by combining a surfactant with a clay mineral, the surfactant containing an anionic surfactant and a specified nonionic surfactant in a specified ratio. In addition, they have found that as an embodiment of realizing the composition, granules having a structure so that the clay mineral is localized in specified portions on a surface site of a detergent granule containing an anionic surfactant and a nonionic surfactant are very excellent in quality aspects such as solidification resistance.

Specifically, the gist of the present invention relates to:

a detergent composition containing:

(a) a nonionic surfactant containing a polyoxyalkylene alkyl ether of which alkylene oxide moiety has an average number of moles of from 4 to 8;

(b) an anionic surfactant, excluding a fatty acid and a salt thereof; and (c) a clay mineral represented by the general formula (I):

$$[Si_8(Mg_aAl_b)O_{20}(OH)_4]^{X-}.Me^{X+} \quad (I)$$

wherein a, b and x satisfy $0<a\leqq 6$, $0<b\leqq 4$, and $x=12-2a-3b$, and Me is at least one member selected from Na, K, Li, Ca, Mg and $NH_4$, wherein the clay mineral is contained in an amount of 3% by weight or more, wherein a weight ratio of the component (a) to the component (b), (a)/(b), exceeds 1 and is less than 5.

Effects of the Invention

By using the detergent composition of the present invention, an effect of preventing a washing item from gray-looking, i.e. redeposition of soils, by washing, can be exhibited, in not only in an ordinary washing, but also even especially in a washing liquid having a high concentration of soils and the like where the amount of the water used in washing is small. Specifically, by applying the present invention, even not only in a case where hydrophilic particles such as sludge are present in a washing liquid, but also in a case where fine hydrophobic particles such as soot are present in a washing liquid, a detergent composition capable of effectively preventing the redeposition of these soils to a washing item in the washing tub, and preventing gray-looking can be provided.

Best Mode for Carrying out the Invention

A feature of the detergent composition of the present invention is in that the detergent composition contains a specified surfactant and a specified clay mineral. The detergent composition of the present invention contains detergent builders such as an alkalizing agent and a metal ion sequestering agent ordinarily contained in a detergent composition, and other ordinary detergent components. The components other than the surfactant and the clay mineral contained in a detergent composition, the form of the detergent composition, and a method for production thereof are not particularly limited. The detergent composition includes, for example, those detergent compositions having the compositions and obtained by a method described in Tokkyocho Koho (Publication of Japan Patent Office), 10 (1998)-25 (7159): Shuchi Kanyo Gijutsu Shu (Iryo-you Funmatsu Senzai) [Well Known Technological Bulletin (Laundry Powder Detergent).

1. Components of Detergent Composition Surfactants

The detergent composition of the present invention contains a nonionic surfactant and an anionic surfactant, in order to give appropriate dispersibility of soils and redeposition preventing ability (hereinafter also referred in the present invention as "redeposition preventing ability").

<(a) Nonionic Surfactants>

The detergent composition of the present invention contains (a) a nonionic surfactant containing a polyoxyalkylene alkyl ether of which alkylene oxide moiety has an average number of moles of from 4 to 8. A polyoxyethyiene alkyl ether of which alkyl moiety has preferably from 10 to 16 carbon atoms, more preferably from 10 to 14 carbon atoms, and most preferably from 12 to 14 carbon atoms, is used, from the viewpoint of detergency. A polyoxyethylene alkyl ether of which alkyl moiety has from 12 to 14 carbon atoms is preferable, and one of which alkyl moiety has 12 carbon atoms is more preferable, from the viewpoint of dissolubility at a low temperature.

The ethylene oxide (EO) has an average number of moles of from 4 to 8, preferably from 4.5 to 8, more preferably from 4.5 to 7, more preferably from 5 to 7, and more preferably from 5 to 6.5, from the viewpoint of redeposition preventing ability of fine hydrophobic particles such as soot. The EO has an average number of moles of preferably from 4.5 to 8, and more preferably from 5 to 7, from the viewpoint of redeposition preventing ability to cotton cloth. In addition, the EO having an average number of moles of preferably from 4 to 7, and more preferably from 4.5 to 6.5, is excellent, from the viewpoint of redeposition preventing ability to a mixed fabric cloth of synthetic and cotton.

It is preferable that the polyoxyalkylene alkyl ether of which oxyalkylene moiety has a number of moles of from 4 to 8 is contained in an amount of 30% by weight or more, preferably 40% by weight or more, preferably 50% by weight or more, and more preferably 60% by weight or more, of the entire amount of the polyoxyalkylene alkyl ether of which oxyalkylene moiety has a number of moles of from 1 to 12.

The average number of moles can be obtained by, for example, the measurement of hydroxylation. Also, in the analysis of the number of moles added, a method employing gas chromatography or LC-mass spectroscopy, more precisely a method including the steps of UV-labeling a terminal hydroxyl group of a nonionic surfactant with 3,5-dinitrobenzoyl chloride, and analyzing by HPLC, can be employed.

In the present invention, the nonionic surfactant of which ethylene oxide has an average number of moles as defined above can be used alone or in a plurality.

In the detergent composition of the present invention, as a nonionic surfactant other than the polyoxyalkylene alkyl ether, a higher fatty acid alkanolamide or an alkylene oxide adduct thereof, a sucrose fatty acid ester, an alkyl glycoside, or a fatty acid glycerol monoester can be properly blended. The polyoxyalkylene alkyl ether is contained in the nonionic surfactant is preferably 70% by weight or more, more preferably 80% by weight or more, even more preferably 90% by weight or more, especially preferably 95% by weight or more, and most preferably 100% by weight.

<(b) Anionic Surfactants>

As the anionic surfactant (b) usable in the detergent composition of the present invention, alkali metal salts of linear alkylbenzenesulfonates, alkyl sulfuric ester salts, polyoxyalkylene alkyl ether sulfates, salts of methyl esters of alpha-sulfofatty acids, N-acyl amino acid-type surfactants, alkyl or alkenyl ether carbonates, amino acid-type surfactants, alkyl or alkenyl phosphoric esters or salts thereof, each of which has an alkyl moiety having preferably from 10 to 18 carbon atoms, more preferably from 12 to 16 carbon atoms, and even more preferably from 12 to 14 carbon atoms, can be used. Especially, the linear alkylbenzenesulfonates and alkyl sulfuric ester salts are preferable. In the present invention, the anionic surfactant (b) excludes a fatty acid and a salt thereof.

Weight Ratio of Nonionic Surfactant (Polyoxyalkylene Alkyl Ether)/Anionic Surfactant [(a)/(b)]

In the present invention, a weight ratio of the formulated nonionic surfactant (a) that contains a polyoxyalkylene alkyl ether of which alkylene oxide moiety has an average number of moles of from 4 to 8 to the formulated anionic surfactant (b) exceeds 1 and is less than 5. The weight ratio exceeds 1, preferably 1.5 or more, more preferably 1.75 or more, even more preferably 2 or more, and still even more preferably 2.5 or more, from the viewpoint of redeposition preventing ability of the fine hydrophobic particles. In addition, the weight ratio is less than 5, preferably less than 4, and more preferably less than 3, from the viewpoint of redeposition preventing ability of the fine hydrophilic particles.

Cationic Surfactants

Furthermore, since a cationic surfactant is likely to accelerate redeposition of the fine particles to a washing item, it is not preferred to use a cationic surfactant; however, a cationic surfactant can be contained within a desired range. Usable cationic surfactants are not particularly limited. The cationic surfactant is contained in the detergent composition in an amount of preferably 2% by weight or less, more preferably 1.5% by weight or less, even more preferably 1% by weight or less, still even more preferably 0.5% by weight or less, and most preferably not containing any cationic surfactants. Especially, it is not preferred to formulate a cationic surfactant in the form that the clay mineral is previously adsorbed thereto, as described in JP-A-Hei-10-168483, from the viewpoint of preventing soil redeposition.

As other surfactant, a surfactant such as a betaine-type amphoteric surfactant or a phosphoric ester surfactant can be properly formulated.

Amount of Surfactant Contained

In the present invention, in a case of a detergent composition containing surfactants, wherein a weight ratio of the nonionic surfactant (a) that contains a polyoxyalkylene alkyl ether of which alkylene oxide moiety has an average number of moles of from 4 to 8 to the anionic surfactant (b) exceeds 1 and is less than 5, and a clay mineral (c) described later, redeposition preventing ability of the soils can be exhibited with an amount of surfactants of a lower concentration, even in a case where the loads of soils dispersed in a washing liquid are high. The nonionic surfactant (a) and the anionic surfactant (b) in the detergent composition of the present invention are contained in a total amount of preferably 10% by weight or more, more preferably 15% by weight or more, even more preferably 17% by weight or more, and still even more preferably 19% by weight or more, from the viewpoint of soil redeposition preventing ability and detergency. In addition, since the component (a) is a liquid at an ambient temperature, the surfactants are contained in a total amount of preferably 30% by weight or less, more preferably 27.5% by weight or less, and even more preferably less than 25% by weight, from the viewpoint of influence to quality of manufactured articles caused by bleeding out from detergent granules.

<(c) Clay Mineral>

The component (c) usable in the detergent composition of the present invention is a smectite-type clay mineral represented by the following general formula (I):

$$[Si_8(Mg_aAl_b)O_{20}(OH)_4]^{X-}.Me^{X+} \quad (I)$$

wherein a and b satisfy $0<a\leqq 6$, and $0<b\leqq 4$, and preferably a, b and x satisfy $0<a<6$, $0<b<4$, $x=12-2a-3b$, and Me is at least one member selected from Na, K, Li, Ca, Mg and $NH_4$.

Since the clay mineral, especially when the clay mineral is a natural product, contains impurity such as quartz, cristobalite, calcite, or feldspar, the amount of the component (c) contained refers to those including these impurities.

Examples of the clay mineral represented by the general formula (I) include "Laundrosil DGA212," "Laundrosil PR414," "Laundrosil DGA214," "Laundrosil DGA Powder," and "Fourasoft-1 Powder" manufactured by Süd-Chemie; "Detersoft GIS", "Detersoft GIB" and "Detersoft GISW" manufactured by Laviosa; Pure Bentonite, Standard Bentonite, and Premier Bentonite manufactured by CSM; and the like.

The component (c) is contained in the detergent composition in an amount of 3% by weight or more, preferably 5% by weight or more, more preferably 7% by weight or more, and even more preferably 10% by weight or more, from the viewpoint of soil redeposition preventing ability. The component (c) is contained in an amount of preferably 25% by weight or less, and more preferably 20% by weight or less, from the viewpoint of the compositional balance.

It is preferable that the detergent composition of the present invention is in the form of powder, from the viewpoint of being capable of formulating many of clay minerals without impairing the external appearance or quality stability of the manufactured article.

As a method of formulating a clay mineral to the detergent composition, for example, a powdery clay mineral may be mixed with other detergent components in the granulating step and surface-modifying step of the powder detergent, to give detergent granules, or granules containing a clay mineral as a main component are previously prepared, and subsequently the granules may be added to other detergent granules in the after-blending step, to give a detergent composition. In a case where the detergent is in a liquid state, the clay mineral may be dissolved and used.

The clay mineral has a Na/Ca weight ratio of preferably 1.0 or more, more preferably 2.0 or more, and even more preferably 3.0 or more, from the viewpoint of soil redeposition preventing ability. As a method of obtaining a clay mineral having a high Na/Ca weight ratio, in a case where the clay mineral is a natural product, a location of produce may be selected, or alternatively, for example, the weight ratio can be adjusted by adding a Na salt or the like upon the production of a clay mineral. In addition, in a case where the clay mineral is a synthetic product, the weight ratio can be arbitrarily adjusted by a known method.

As a method for producing a clay mineral having a high Na/Ca weight ratio, the following method is useful: A method including the steps of adding a powdery Na salt such as sodium carbonate to a raw material clay ore containing 20% or more water, and drying the mixture; or a method including the step of adding a powdery or aqueous Na salt, such as sodium carbonate, upon granulating a clay mineral pulverized into a powdery state using a granulator.

<Determination of Na/Ca Weight Ratio of Clay Mineral>

Here, the Na/Ca weight ratio of the clay mineral is determined by the following method. A clay mineral is pulverized with a mortar, and a 0.1 g sample which is a 125 μm sieve-passed sample, is allowed to undergo sulfuric acid-hydrogen peroxide degradation with a microwave wet-type ashing apparatus (automatic). The degraded sample is placed in a measuring flask, and filled up to a volume of 50 mL. The diluted sample is subjected to determination with an ICP emission analysis apparatus to quantify Na and Ca to calculate the weight ratio.

Similarly, the weight proportion of Ca contained in the clay mineral is preferably 5% by weight or less, more preferably 3% by weight or less, and even more preferably 1% by weight or less, of the clay mineral, from the viewpoint of soil redeposition preventing ability. The weight proportion of Ca can be calculated by comparing the quantified value of Ca with the weight of the sample, in the same manner as the above-mentioned Na/Ca weight ratio.

<Clay Granules>

In one embodiment of the composition of the present invention, all or a part of the component (c) may be used in the form of clay granules. The clay granules as used herein may be those clay granules having an undissolved ratio as defined by the formula (II) of from 0.2 to 2.5%, from the viewpoint of dispersibility and residual property on clothes, under stirring conditions that 1 g of the clay granules are supplied to 1-liter of deionized water at 20° C. in a 1-liter beaker (inner diameter: 105 mm) and stirred with a stirring bar (length: 35 mm, and diameter: 8 mm) at a rotational speed of 800 rpm for 20 minutes, when filtered with a standard sieve (sieve opening: 74 μm) as prescribed in JIS Z 8801, wherein the undissolved ratio is calculated by the formula (II):

$$\text{Undissolved Ratio}(\%)=T/S\times 100 \quad \text{(II)}$$

wherein S is a weight (g) of the clay granules supplied; and T is a dry weight (g) of undissolved granules remaining on the sieve when an aqueous solution prepared under the above stirring conditions is filtered with the sieve, under drying conditions that the granules are kept at 105° C. for 1 hour, and thereafter kept in a desiccator containing silica gel at 25° C. for 30 minutes.

Here, it is preferable that clay mineral is contained in the clay granules in an amount of 35% by weight or more, as described later.

The clay granules have an undissolved ratio represented by the formula (II) of preferably 0.2% or more, more preferably 0.4% or more, and even more preferably 0.6% or more, from the viewpoint of dispersibility. In addition, the clay granules have an undissolved ratio of preferably 2.5% or less, more preferably 2.2% or less, even more preferably 1.7% or less, and still even more preferably 1.3% or less, from the viewpoint of controlling residues of undissolved products on clothes.

As a method of adjusting the undissolved ratio as defined in the present invention to a desired proportion, the undissolved ratio can be adjusted in a step before the granulating step, for example, the step of pulverizing raw materials. Specifically, the undissolved ratio can be adjusted by adjusting a pulverization time or the like in the case of a batch process, or the undissolved ratio can be adjusted by adjusting the number of rotations of a pulverizer, classifying condition, or the like in the case of a continuous process.

Further, the amount of Na in the clay granules is preferably 1.0% by weight or more, more preferably 1.5% by weight or more, and even more preferably 2.0% by weight or more, from the viewpoint of improving dispersibility of the clay granules. In addition, the Na/Ca weight ratio in the clay granules is preferably 1.0 or more, more preferably 1.5 or more, and even more preferably 2.0 or more, similarly from the viewpoint of improving dispersibility of the clay granules.

The phrase "the amount of Na in the clay granules is 1.0% by weight or more" refers to clay granules in which Na determined by the method as described above is 1.0% by weight or more, and the source of Na includes those in which Na previously exists in the ore, and a Na salt that can be added in the production steps of the clay granules.

<Method for Producing Clay Granules>

By using the clay granules produced according to the following method, a detergent composition in which impurities contained in the clay mineral and the clay granules are less likely to remain on clothes can be provided.

A method for producing clay granules for a detergent composition includes the steps of pulverizing a clay mineral containing a smectite-type clay mineral as a main component and having a water content of from 6 to 18% by weight with a pulverizer equipped with a classifying mechanism using a humidity-controlled dry air, thereby reducing a water content of the clay mineral after the pulverization by 5% or more from the water content of the clay mineral before the pulverization.

The clay mineral before the pulverization has a water content of preferably from 6 to 18% by weight, more preferably from 7 to 16% by weight, and even more preferably from 8 to 14% by weight, from the viewpoint of controlling deposition inside the pulverizer and pulverizability. By using a humidity-controlled dry air upon pulverizing the clay mineral using the pulverizer equipped with a classifying mechanism, the water content after the pulverization can be adjusted. The dry air has humidity of preferably a relative humidity of 50% or less at a temperature of 20° to 30° C., more preferably a relative humidity of 35% or less, and even more preferably a relative humidity of 20% or less, from the viewpoint of pulverizability. In addition, it is very effective in suppressing the deposition of the clay mineral to the classifying apparatus by carrying out air classification using the dry air.

Further, it is important that the water content after the pulverization is reduced by 5 to 25% from the water content of the clay mineral before the pulverization, in order to adjust the undissolved ratio in the clay granules to a desired range, and the water content after the pulverization is preferably from 7 to 22% by weight, and more preferably from 10 to 20% by weight.

<Copolymer for Preventing Redeposition>

In one embodiment of the composition of the present invention, the composition may contain a copolymer containing a constituting unit derived from N-vinylpyrrolidone, for the purpose of enhancing redeposition preventing ability. In the copolymer containing a constituting unit derived from N-vinylpyrrolidone, the constituting units other than the constituting unit derived from N-vinylpyrrolidone are not particularly limited. The copolymer containing the constituting unit derived from N-vinylpyrrolidone is considered to have a high affinity to a hydrophobic surface, and especially the redeposition preventing ability of the fine hydrophobic particles to clothes containing synthetic can be enhanced. In a system of a combined use with the clay mineral (c), the molar ratio of the constituting units derived from N-vinylpyrrolidone to the entire constituting units [N-vinylpvrrolidone/entire constituting units] is preferably from 10/100 to 50/100, more preferably from 10/100 to 40/100, and even more preferably from 10/100 to 30/100, from the viewpoint of effectively enhancing redeposition preventing ability of soils.

In addition, the copolymer containing a constituting unit derived from N-vinylpyrrolidone has a weight-average molecular weight of preferably from 5,000 to 100,000, more preferably from 8,000 to 50,000, and even more preferably from 10,000 to 30,000, from the viewpoint of effectively enhancing redeposition preventing ability of soils.

The weight-average molecular weight of the copolymer is usually determined by using gel permeation chromatography (GPC). DMF (N,N-dimethylformamide) is used as a solvent, and polyethylene glycol (PEG) is used as a standard substance. As an example, the weight-average molecular weight can be obtained by using GPC manufactured by Showa Denko (organic solvent column: Shodex Asahipac Series GPC KD-803 or GPC KD-804), a RI detector (RI-71,101, manufactured by Showa Denko), a UV detector (UV-41, manufactured by Showa Denko), or the like.

In one embodiment of the composition of the present invention, the copolymer is contained in the detergent composition in an amount of preferably from 0.01 to 10% by weight, more preferably from 0.05 to 5% by weight, and even more preferably from 0.1 to 3% by weight, from the viewpoint of preventing redeposition. One or more kinds of copolymers may be used within the above range.

As the copolymer containing a constituting unit derived from N-vinylpyrrolidone, for example, the following copolymers (1) and (2) can be preferably used. Both of them are copolymers, so that both similarly show a more excellent property than the N-vinylpyrrolidone homopolymer.

(1) A copolymer containing a constituting unit derived from N-vinylpyrrolidone and a constituting unit derived from vinyl acetate.

(2) A copolymer containing a constituting unit derived from N-vinylpyrrolidone and a constituting unit derived from N-vinyl imidazole.

<N-Vinylpyrrolidone/Vinyl Acetate Copolymer>

In one embodiment of the composition of the present invention, it is preferable that the final form of the N-vinylpyrrolidone (VP)/vinyl acetate (VA) copolymer is a white powder, an aqueous solution of an ethanol solution, an isopropanol solution, or the like. A method for producing the copolymer includes a method of directly producing the copolymer in an organic solvent, preferably an aliphatic hydrocarbon, and more preferably cyclohexane, heptane, or a mixture thereof, in the presence of a given amount of a free polymerization initiator. An appropriate polymerization initiator includes azyl peroxides including, for example, diacetyl peroxide, dibenzoyl peroxide, and dilauryl peroxide; peracid esters including, for example, t-butyl peroxy pivalate, t-butyl peroxy-2-ethyl hexanoate; peroxides including, for example, di-t-butyl peroxide; peroxycarbonates including, for example, dicyclohexyl peroxydicarbonate; and azo compounds, including for example, 2,2'-azobis(isobutyronitrile), 2,2'-azobis(2,4-dimethylvaleronitrile), 1,1'-azobis(cyanocyclohexane), and 2,2'-azobis(methylbutyronitrile). Also, other polymerization initiators that are known to one of ordinary skill in the art can be used.

The amount of the polymerization initiator as mentioned above can be changed in a wide range. In general, the polymerization initiator can be used in an amount of about 0.2 to about 5.0% based on the weight of the introduced entire constituting units. The reaction temperature can be changed in a wide range; in general, the reaction mixture can be maintained during the polymerization at a temperature of preferably from 40° to 150° C., and more preferably from 60° to 70° C. The pressure is usually kept at an atmospheric pressure, and an even higher pressure or an even lower pressure can be similarly used. After the initiation of the polymerization, other polymerization initiator may be further introduced thereinto at a relatively higher operating temperature (60° to 80° C.). This is because this polymerization initiator serves to effectively lower the amount of the residual VP and VA constituting units to a level of less than 100 ppm in the resulting product. The relatively high-temperature polymerization initiator as described above can be added to the system individually, or in a mixture with a low-temperature polymerization initiator. Preferred relatively high-temperature polymerization initiator is 2,5-dimethyl-2,5-di(t-butylperoxy) hexane (Lupersol (registered trade mark) 101). The total amount of the polymerization initiators including the polymerization initiator as described above can also be from about 0.2 to about 5.0%, based on the weight of the introduced entire constituting units.

The polymerization can be carried out by first previously introducing a given amount of an organic solvent, for example, an aliphatic hydrocarbon solvent, into an appropriate reactor, heating this solvent to a desired reaction temperature, and at the same time vigorously stirring under an inert gas atmosphere. Next, a polymerization initiator is introduced into the reactor, and thereafter constituting units derived from vinylpyrrolidone and vinyl acetate can be continuously introduced into the reactor with a syringe pump. The ratio of the amount of each constituting unit can be adjusted based on a desired ratio of a specified vinylpyrrolidone to vinyl acetate in the copolymer. Vinyl pyrrolidone is by far highly reactive as compared to that of vinyl acetate during the polymerization, so that it is desired to provide a substantially uniform copolymer in connection with the distributions of the constituting units on the polymer main chain. Therefore, it is preferable that in a case where the time period of adding vinyl acetate is relatively shortened, the time period is usually from 3 to 5 hours, and that in a case where the time period of adding vinyl pyrrolidone is relatively lengthened, the time period is usually from 5 to 7 hours. It is preferable that the reaction mixture is introduced into the reactor to a level below the liquid surface of the solvent. The reaction mixture having added with a high-temperature polymerization initiator, for example, 2,5-dimethyl-2,5-di(t-butylperoxy)hexane (Lupersol (registered trade mark) 101) is further kept at a relatively high temperature (60° to 80° C.) for a certain period of time, usually from 6 to 8 hours, and whereby the polymerization can be completed. Finally, the reaction mixture is cooled to room temperature, the cooled mixture is filtered, the residue is washed with a solvent and dried, and whereby a desired copolymer can be obtained in a quantitatively approximate yield. Alternatively, the reaction mixture may be directly dried, and whereby a copolymer powder can be obtained.

The glass transition temperature Tg showing a state of the copolymer is such that if the copolymer is at a temperature above this temperature, the copolymer is in a viscous state or an elastic state, and that if the copolymer is at a temperature below this temperature, the copolymer is in a rigid state or a glassy state. The Tg is associated with the amount of free terminal groups of the copolymer. The resulting N-vinylpyrrolidone/vinyl acetate copolymer has a Tg of preferably within the range of from 50° to 130° C., more preferably from 55° to 120° C., and even more preferably from 70° to 110° C., in order to synthesize an ordinary copolymer without causing any crosslinking reactions.

The N-vinylpyrrolidone/vinyl acetate copolymer has a weight-average molecular weight preferably from 5,000 to 70,000, preferably from 8,000 to 50,000, and more preferably from 10,000 to 30,000, from the viewpoint of effectively enhancing the redeposition prevention of the soils.

In the copolymer, the molar ratio of the constituting units derived from N-vinylpyrrolidone to the constituting units derived from vinyl acetate [N-vinylpyrrolidone/vinyl acetate] is preferably from 10/90 to 50/50, more preferably from 10/90 to 40/60, and even more preferably from 10/90 to 30/70, from the viewpoint of effectively enhancing redeposition prevention of the soils.

The copolymer may be a copolymer containing a constituting unit derived from a vinyl alcohol in the entire constituting monomers.

A method of allowing a copolymer to contain a constituting unit derived from a vinyl alcohol includes the following method. In general if an acetic acid ester residue of polyvinyl acetate is hydrolyzed with a dilute acid or an alkali, a polyvinyl alcohol is obtained. Vinyl alcohol (enol tautomer of acetaldehyde) is labile in its molecular structure, so that the vinyl alcohol cannot be directly polymerized as a constituting unit. Therefore, vinyl alcohol is allowed to be contained through vinyl acetate.

The copolymer contains the constituting unit derived from the vinyl alcohol in an amount of preferably from 0 to 15% by mol, more preferably from 0 to 10% by mol, and even more preferably from 0 to 5% by mol, of the entire constituting monomers, from the viewpoint of effectively enhancing redeposition prevention of the soils.

The detergent composition of the present invention can contain the copolymer (2): A copolymer containing a constituting unit derived from N-vinylpyrrolidone and a constituting unit derived from N-vinyl imidazole. The copolymer as used herein may be hereinafter simply referred to as "N-vinylpyrrolidone/N-vinyl imidazole copolymer" in some cases.

<(2) N-Vinylpyrrolidone/N-Vinyl Imidazole Copolymer>

The detergent composition of the present invention can preferably contain the copolymer (2): A copolymer containing a constituting unit derived from N-vinylpyrrolidone and a constituting unit derived from N-vinyl imidazole. The copolymer as used herein may be hereinafter simply referred to as "N-vinylpyrrolidone/N-vinyl imidazole copolymer" in some cases.

The N-vinylpyrrolidone/N-vinyl imidazole copolymer of the present invention has a weight-average molecular weight of preferably from 10,000 to 100,000, preferably from 55,000 to 100,000, and more preferably from 60,000 to 80,000, from the viewpoint of enhancing redeposition preventing ability.

The N-vinylpyrrolidone/N-vinyl imidazole copolymer (PVP/PVI copolymer) can be copolymerized by the production method with a radical initiator, as described in JP-B-3272359, JP-B-3272362, or the like.

Here, the above-mentioned "copolymer for preventing redeposition" of the present invention can also be used regardless of the kinds of the surfactants. In other words, the copolymer can be used regardless of the ratio of the nonionic surfactant/the anionic surfactant.

<(d) Acrylic Acid-Based Polymer>

Further, it is preferable that the detergent composition of the present invention contains an acrylic acid-based polymer, such as a polyacrylic acid or a salt thereof having a weight-average molecular weight of from 5,000 or more and 100,000 or less, or an acrylic acid-maleic acid copolymer or a salt thereof having a weight-average molecular weight of from 5,000 or more and 100,000 or less. Since these polymers have excellent dispersibility in fine hydrophilic particles such as sludge, redeposition preventing ability of these particles is exhibited. Further, in the presence of carbonate ions, there is an effect of accelerating the improvement in redeposition preventing ability of fine hydrophobic particles such as soot by the above-mentioned clay mineral. From this viewpoint, the component (d) is contained in the detergent composition in an amount of preferably 0.5% by weight or more, more preferably 1.0% by weight or more, even more preferably 2.0% by weight or more, and still even more preferably 3.0% by weight or more. The polyacrylic acid or a salt thereof is more preferable, from the viewpoint of sludge soil redeposition preventing ability. The polyacrylic acid or a salt thereof has a weight-average molecular weight of preferably from 5,000 or more and 50,000 or less, and more preferably from 5000 or more and 30,000 or less, from the viewpoint of soil redeposition preventing ability.

<(e) Alkalizing Agent>

Further, in the present invention, it is preferable to use an alkalizing agent. Usable alkalizing agents include those that are conventionally known. It is preferable to separately formulate the alkalizing agent in the detergent composition from the viewpoint of detergency. Examples of the alkalizing agent include alkali metal salts including alkali metal carbonates such as sodium carbonate collectively referred to as dense soda ash and light soda ash; amorphous alkali metal silicates, such as JIS No. 1, 2 or 3; crystalline alkali metal silicates; and the like. From the viewpoint of detergency, the alkalizing agent is contained in an amount of preferably 5% by weight or more, more preferably 10% by weight or more, and even more preferably 15% by weight or more, of the detergent composition. In addition, the alkalizing agent is contained in an amount of preferably 50% or less, more preferably 40% or less, and even more preferably 35% or less, of the detergent composition, from the viewpoint of compositional balance.

<(f) Metal Ion Sequestering Agent>

It is preferable to formulate a metal ion sequestering agent because the agent has an effect of suppressing the acceleration of soil deposition caused by enhancement in the salt strength. It is very effective to formulate a metal ion sequestering agent as a builder in the detergent composition to sequester water hardness-increasing components in a washing water. Especially, it is more effective to formulate a metal ion sequestering agent having a calcium ion sequestering ability of 100 mg $CaCO_3$/g or more. The metal ion sequestering agent includes a crystalline aluminosilicate, a crystalline sodium silicate, sodium tripolyphosphate, ethylenediaminetetraacetic acid, and methylglycinediacetic acid. Here, in the present invention, sodium carbonate and amorphous sodium silicate are not included in the metal ion sequestering agent. The metal ion sequestering agent is contained in an amount of preferably 1% by weight or more, more preferably 5% by weight or more, even more preferably 10% by weight or more, and especially preferably 20% by weight or more, of the detergent composition, from the viewpoint of detergency. In addition, the metal ion sequestering agent is contained in an amount of preferably 50% by weight or less, more preferably 40% by weight or less, and even more preferably 35% by weight or less, of the detergent composition, from the viewpoint of compositional balance.

<Other Polymers>

In addition, the detergent composition of the present invention can be formulated with an organic polymer having a weight-average molecular weight of several thousands to several one-hundred thousands, for example, polyethylene glycol, carboxymethyl cellulose, polyvinyl alcohol, or the like, within the range so as not to impair the effects of the present invention. It is preferred not to formulate an organic polymer having a weight-average molecular weight of 300,000 or more, from the viewpoint of redeposition preventing ability.

<Polyethylene Glycol>

The polyethylene glycol has an action of dispersing solid particle soils into a washtub. A polyethylene glycol having a weight-average molecular weight of 1,000 or more and 20,000 or less is preferable.

<Carboxymethyl Cellulose>

The carboxymethyl cellulose has an action of dispersing solid particle soils into a washtub. A carboxymethyl cellulose having a weight-average molecular weight of 1,000 or more and 100,000 or less and a degree of etherification of from 0.2 to 1.0 is preferable.

<Fluorescent Agent>

The detergent composition of the present invention can be preferably formulated with a fluorescent agent. As the fluorescent agent, a biphenyl-type fluorescent agent or a stilbene-type fluorescent agent can be used.

The biphenyl-type fluorescent agent includes 4,4'-bis(2-sulfostyryl)biphenyl disodium and 4,4'-bis(2-sulfo-4-chlorostyryl)biphenyl disodium, and especially 4,4'-bis(2-sulfostyryl)biphenyl disodium is preferred. Trade names include Tinopal CBS-X (manufactured by Ciba Specialty Chemicals K.K.), and the like.

The stilbene-type fluorescent agent is preferably a compound of the general formula (III). In the formula, the cation of M' includes alkali metal ions such as sodium ions, alkaline earth metal ions such as magnesium ions, and ammonium ions. Especially, the alkali metal ions are preferred. This compound is available as Tinopal AMS-GX (manufactured by Ciba Specialty Chemicals K.K.).

(III)

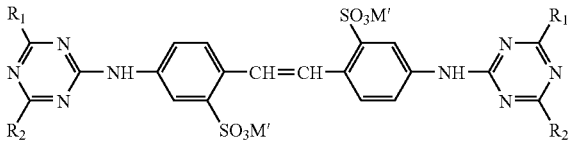

wherein $R_1$'s, each of which may be identical or different, is

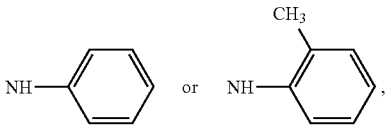

$R_2$'s, each of which may be identical or different, is $NHCH_2CH_2OH$,

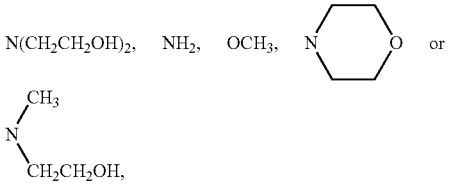

and M' is a cation.

The weight ratio of [Stilbene-type Fluorescent Agent/Entire Fluorescent Agents] is preferably 0/100 or more and 75/100 or less, more preferably 0/100 or more and 50/100 or less, even more preferably 0/100 or more and 25/100 or less, and still even more preferably 0/100 or more and 10/100 or less, from the viewpoint of enhancing the effect of the clay mineral on redeposition preventing ability of fine hydrophobic particles against a mixed fabric of synthetic/cotton.

The stilbene-type fluorescent agent is contained in an amount of preferably 0% by weight or more and 0.3% by weight or less, more preferably 0% by weight or more and 0.15% by weight or less, and 0% by weight or more and 0.05% by weight or less, of the detergent composition, from the viewpoint of enhancing the effect of the clay mineral on redeposition preventing ability of fine hydrophobic particles against a mixed fabric of synthetic/cotton.

<Other Additives>

The detergent composition of the present invention can properly formulated with an enzyme, a perfume, a colorant (a pigment or dye), and the like.

2. Structure of Detergent Composition

As one embodiment of the detergent composition of the present invention, it is preferable that a detergent composition contains (A) detergent granules and (B) clay granules, from the viewpoint of solidification resistance and bleed-out resistance of a surfactant or the like and storage stability, wherein the components (A) and (B) are defined as follows.

(A) detergent granules having a structure that the component (c) clay mineral is present on a surface of surfactant-containing granules containing the component (a) and the component (b), and a side of a layer of the surface is further coated with a surface-modifying agent; and (B) clay granules containing the component (c) clay mineral in an amount of 35% by weight or more.

The method for producing the detergent granules (A) is not particularly limited, and the detergent granules can be obtained by, for example, the following steps:

(I) mixing detergent base granules capable of absorbing a surfactant in an inner portion or a surface layer thereof, with a clay mineral (c) while stirring;

(II) adding a surfactant composition containing components (a) and (b) to the granules obtained in the step (I) and mixing the components, thereby absorbing the surfactant composition thereto; and (III) adding a surface-modifying agent to the granules obtained in the step (II) and mixing the components, thereby coating a surface layer of the granules with a surface-modifying agent.

In addition, the detergent granules (A) may be obtained by the steps of firstly mixing a surfactant composition with detergent base granules, thereby absorbing the surfactant composition, then adding a clay mineral (c) thereto, and subsequently surface-modifying the resulting granules, or may be obtained by adding almost concurrently the surfactant composition and the clay mineral to the detergent base granules, and surface-modifying the resulting granules, where allowable.

Here, the detergent base granules are granules that contain one or more members of surfactants, inorganic salts and polymers that are generally known as detergent components, and are in the state before coating with the clay mineral (c), the surfactant composition or the surface-modifying agent. The detergent base granules may be those obtained by spray-drying an aqueous slurry solution containing a surfactant, an inorganic salt or a polymer, or the detergent base granules may be an appropriate inorganic salt. In order to stably absorb a liquid surfactant composition, those having structures that can hold the liquid in the inner portion are preferable. For example, base granules as disclosed in JP-A-Hei-11-29830 can be suitably used.

The clay mineral (c) in the above detergent granules (A) has an effect of controlling bleed-out of a liquid surfactant composition in the detergent composition according to the present invention. In addition, since the clay mineral shows adhesion upon containing the liquid components, the clay mineral also has an effect of controlling removal of a surface-modifying agent. For this reason, an efficient surface modification is carried out. In order to exhibit these effects, a state in which the clay mineral is efficiently dispersed on the surface of the detergent base granules is advantageous. From this aspect, the clay mineral has an average particle size of preferably from 1 to 80 μm, more preferably from 1 to 60 μm, even more preferably from 1 to 40 μm, and especially preferably from 1 to 20 μm. In addition, in order to sufficiently obtain the effects of the present invention, the clay mineral is preferably 0.5 parts by weight or more, more preferably 1 part by weight or more, even more preferably 2 parts by weight or more, still even more preferably 3 parts by weight or more, and especially preferably 4 parts by weight or more, based on 100 parts by weight of the detergent base granules. In addition, the clay mineral is preferably 20 parts by weight or less, more preferably 15 parts by weight or less, and even more preferably 12 parts by weight or less, from the viewpoint of free-flowability of the detergent granules.

Here, the average particle size of the above-mentioned component (c) can be measured by using, for example, a laser diffraction/scattering particle size distribution measurement apparatus having a dry measurement unit. Specifically, the average particle size can be measured by connecting a dry measurement unit G0310630 as an option to Partica LA-950 (manufactured by HORIBA, Ltd.) using Mie scattering method. The average particle size is measured at normal mode by the setting of the compressed air for powder dispersion, and a median diameter obtained is defined as an average particle size of the clay mineral.

The surfactant composition is a mixture mainly containing a nonionic surfactant (a) and an anionic surfactant (b) in the present invention, which may also contain other nonionic surfactant and anionic surfactant, an amphoteric surfactant, a cationic surfactant, a fatty acid salt, a polyethylene glycol, a polypropylene glycol, a Pluronic nonionic surfactant, or the like. Those surfactant compositions in a liquid state upon mixing with the detergent base granules are preferred.

The surface-modifying agent is a powder to be formulated to cover the surface of the detergent granules, thereby improving free-flowability of the detergent granules. Specifically, an aluminosilicate is desired. Besides the aluminosilicate, fine inorganic powder of a silicate compound such as calcium silicate or a crystalline silicate compound is preferred. Those surface-modifying agents of which primary granules have an average particle size of 10 μm or less are preferred, and more preferably from 0.1 to 10 μm, from the viewpoint of improving a coating ratio of the detergent granule surface and improving free-flowability of the detergent granules. The amount of the surface-modifying agent used is preferably 5 parts by weight or more, and more preferably 10 parts by weight, based on 100 parts by weight of the mixture obtained in the step (II), from the viewpoint of efficiency of surface coating. The amount of the surface-modifying agent used is preferably 100 parts by weight or less, more preferably 75 parts by weight or less, and even more preferably 50 parts by weight or less, from the viewpoint of free-flowability.

The clay granules (B) contain the clay mineral represented by the general formula (I) mentioned above in an amount of preferably 35% by weight or more, more preferably 50% by weight or more, more preferably 60% by weight or more, and even more preferably 70% by weight or more.

Since the clay granules (B) are separate granules from the detergent granules (A) containing surfactants, and the like, there is an effect of preventing adhesion between the detergent granules (A) themselves accompanying intrusion of a wetting component or the like of the vessel. From this viewpoint, the clay granules (B) are contained in an amount of preferably 3% by weight or more, more preferably 4% by weight or more, even more preferably 5% by weight or more, and still even more preferably 7% by weight or more, of the detergent composition. It is preferable that the clay granules are contained in an amount of 20% by weight or less, from the viewpoint of compositional balance.

In the present invention, the clay granules have a bulk density of preferably from 500 to 1200 g/L, more preferably from 600 to 1100 g/L, and even more preferably from 700 to 1050 g/L, from the viewpoint of non-classifiable property. The clay granules have an average particle size of preferably from 200 to 1000 μm, more preferably from 300 to 900 μm, and even more preferably from 400 to 800 μm, from the viewpoint low-dust generating property and non-classifiable property.

Moreover, clay granules contain granules having sizes of from 180 to 1410 μm in an amount of preferably 90% by weight or more of the entire granules, and more preferably 95% by weight or more, from the viewpoint of dust generating property and external appearance.

The water content of the clay granules is preferably 18% by weight or less, 16% by weight or less, and even more preferably 14% by weight or less, from the viewpoint of particle strength.

An aqueous solution (dispersion) of the clay granules has a pH of preferably 9.0 or more, more preferably 9.5 or more, and even more preferably 10.0 or more, under the measurement conditions at 20° C. and 2% by weight using a glass electrode method, from the viewpoint of quality control.

[Average Particle Size]

The average particle size of the granules such as the detergent granules and clay granules, usable in the present invention is obtained from the weight percentages according to the sizes of each of the standard sieves as prescribed in JIS Z 8801 after vibrating the sieves for five minutes.

[Bulk Density]

Similarly, the bulk density of the detergent granules and the like is determined by the method defined in JIS K 3362.

EXAMPLES

Examples 1 to 7 and Comparative Examples 1 to 5

A detergent base was obtained from components excluding a clay mineral, enzymes, perfume, and 3% by weight of a zeolite for surface modification. The remaining components were mixed with the detergent base, to give a detergent composition. The components of the detergent composition are shown in Table 1.

Examples 8 to 10 and Comparative Example 6

A detergent composition was obtained in the same manner as above. The components of the detergent composition are shown in Table 2.

TABLE 1

| Components of Detergent Composition (% by weight) | | Composition No. 1 Ex. | 2 Ex. | 3 Ex. | 4 Ex. | 5 Ex. | 6 Ex. | 7 Ex. | 1 Comp. Ex. | 2 Comp. Ex. | 3 Comp. Ex. | 4 Comp. Ex. | 5 Comp. Ex. |
|---|---|---|---|---|---|---|---|---|---|---|---|---|---|
| | Nonionic Surfactant 1 (EO3) | | | | | | | | | | | | 13 |
| (a) | Nonionic Surfactant 2 (EO5) | 6 | | | | 6 | 6 | 6 | | | | | |
| | Nonionic Surfactant 3 (EO6) | 6 | 14 | 17 | 8 | 6 | 7 | 6 | 12 | | | 20 | |
| | Nonionic Surfactant 4 (EO8) | | | | 8 | | | | | 5 | | | |
| | Nonionic Surfactant 5 (EO12) | | | | | | | | | | 12 | | |
| (b) | Anionic Surfactant 1 | 8 | 5 | 7 | 5 | 8 | 2 | 8 | 8 | 15 | 10 | | 7 |
| | Anionic Surfactant 2 | | 2 | 2 | | | 5 | | | | | | |
| (c) | Clay Mineral 1 | 13 | 10 | 7 | 12 | | 5 | 8 | | 5 | 8 | 5 | 4 |
| | Clay Mineral 2 | | | | | 10 | | | | | | | |

TABLE 1-continued

| Components of Detergent Composition (% by weight) | Composition No. 1 Ex. | 2 Ex. | 3 Ex. | 4 Ex. | 5 Ex. | 6 Ex. | 7 Ex. | 1 Comp. Ex. | 2 Comp. Ex. | 3 Comp. Ex. | 4 Comp. Ex. | 5 Comp. Ex. |
|---|---|---|---|---|---|---|---|---|---|---|---|---|
| (d) Sodium Polyacrylate | 3.5 | 5.0 | 3.0 | 5.0 | 3.5 | 5.0 | 5.0 | 2.0 | 3.0 | 0.0 | 1.0 | 1.5 |
| (e) Sodium Carbonate | 20 | 20 | 10 | 20 | 20 | 22 | 22 | 20 | 20 | 20 | 20 | 25 |
| Crystalline Silicate | 1 | 1 | 1 | 1 | 1 | 1 | 1 | 1 | 1 | 1 | 1 | 1 |
| (f) Zeolite | 23 | 22 | 28 | 23 | 23 | 25 | 25 | 23 | 23 | 23 | 23 | 23 |
| PEG | 0.5 | 0.5 | 0.5 | 0.6 | 0.5 | 0.5 | 0.5 | 0.5 | 0.3 | 0.5 | 0.5 | 0.5 |
| Enzymes | 0.4 | 0.4 | 0.4 | 0.4 | 0.4 | 0.4 | 0.4 | 0.4 | 0.4 | 0.4 | 0.4 | 0.4 |
| Perfume | 0.3 | 0.3 | 0.3 | 0.3 | 0.3 | 0.3 | 0.3 | 0.3 | 0.3 | 0.3 | 0.3 | 0.3 |
| Sodium Sulfate | 14 | 11 | 16 | 14 | 14 | 14 | 14 | 14 | 20 | 20 | 20 | 20 |
| Soap | 1 | 1 | 1 | 1 | 1 | 1 | 1 | 1 | 1 | 1 | 1 | 1 |
| Fluorescent Agent 1 | | 0.06 | 0.05 | 0.06 | 0.1 | 0.12 | 0.1 | 0.06 | 0.06 | 0.06 | 0.06 | 0.06 |
| Fluorescent Agent 2 | | 0.13 | 0.14 | 0.13 | 0.1 | | 0.12 | 0.13 | 0.13 | 0.13 | 0.13 | 0.13 |
| PVP/VA Copolymer | | | | | | | 1 | | | | | |
| Water | Bal. | Bal. | Bal. | Bal. | Bal. | Bal. | Bal. | Bal. | Bal. | Bal. | Bal. | Bal. |
| [(a)/(b)] | 1.5 | 2.0 | 1.9 | 3.2 | 1.5 | 1.9 | 1.5 | 1.5 | 0.3 | 0 | — | 0 |
| Evaluation (%) | | | | | | | | | | | | |
| Carbon Redeposition Preventing Ability cotton knit | 85 | 84 | 82 | 81 | 79 | 81 | 86 | 75 | 75 | 65 | 82 | 67 |
| Sludge Redeposition Preventing Ability cotton knit | 80 | 80 | 78 | 79 | 78 | 80 | 80 | 75 | 78 | 73 | 72 | 75 |

TABLE 2

| Components of Detergent Composition (% by weight) | Composition No. 8 Ex. | 9 Ex. | 10 Ex. | 6 Comp. Ex. |
|---|---|---|---|---|
| Nonionic Surfactant 1(EO3) | | | | |
| (a) Nonionic Surfactant 2 (EO5) | 6 | 6 | 6 | 6 |
| Nonionic Surfactant 3 (EO6) | 6 | 6 | 6 | 6 |
| Nonionic Surfactant 4 (EO8) | | | | |
| Nonionic Surfactant 5 (EO12) | | | | |
| (b) Anionic Surfactant 1 | 9 | 8 | 8 | 8 |
| Anionic Surfactant 2 | | | | |
| (c) Clay Mineral 1 | 10 | 9 | 10 | |
| Clay Mineral 2 | | | | |
| (d) Sodium Polyacrylate | 5.0 | 4.0 | 4.5 | 3.0 |
| (e) Sodium Carbonate | 20 | 18 | 16 | 10 |
| Crystalline Silicate | 1 | 1 | 1.5 | 1 |
| (f) Zeolite | 25 | 28 | 27 | 28 |
| PEG | 0.5 | 0.5 | 0.5 | 0.5 |
| Enzymes | 0.4 | 0.4 | 0.4 | 0.4 |
| Perfume | 0.3 | 0.3 | 0.3 | 0.3 |
| Sodium Sulfate | 11 | 16 | 16 | 16 |
| Soap | 1 | 1 | 1 | 1 |
| Fluorescent Agent 1 | 0.05 | 0.1 | | |
| Fluorescent Agent 2 | 0.1 | 0.02 | | |
| PVP/VA Copolymer | | | 1.0 | |
| Water | Bal. | Bal. | Bal. | Bal. |
| [(a)/(b)] | 1.3 | 1.5 | 1.5 | 1.5 |
| Evaluation (%) | | | | |
| Carbon Redeposition Preventing Ability T/C | 80 | 88 | 91 | 75 |
| Sludge Redeposition Preventing Ability T/C | 79 | 88 | 88 | 75 |

Here, in Examples 1 to 10 and Comparative Examples 1 to 6, the followings were used as each of the components.

Nonionic Surfactant 1 (Polyoxyalkylene Alkyl Ether 1): a product prepared by adding EO in an average of 3 mol to a primary alcohol having 10 to 14 carbon atoms;

Nonionic Surfactant 2 (Polyoxyalkylene Alkyl Ether 2): a product prepared by adding EO in an average of 5 mol to a primary alcohol having 10 to 14 carbon atoms;

Nonionic Surfactant 3 (Polyoxyalkylene Alkyl Ether 3): a product prepared by adding EO in an average of 6 mol to a primary alcohol having 10 to 14 carbon atoms;

Nonionic Surfactant 4 (Polyoxyalkylene Alkyl Ether 4): a product prepared by adding EO in an average of 8 mol to a primary alcohol having 10 to 14 carbon atoms;

Nonionic Surfactant 5 (Polyoxyalkylene Alkyl Ether 5): a product prepared by adding EO in an average of 12 mol to a primary alcohol having 10 to 14 carbon atoms;

Anionic Surfactant 1: a sodium linear alkylbenzenesulfonate of which alkyl group has 12 to 14 carbon atoms;

Anionic Surfactant 2: a sodium linear alkyl sulfate of which alkyl group has 12 to 14 carbon atoms;

Clay Mineral 1: bentonite having a Na/Ca weight ratio of 3;

Clay Mineral 2: bentonite having a Na/Ca weight ratio of 0.1;

PEG: polyethylene glycol (weight-average molecular weight: 10,000);

Crystalline Silicate: "Prefeed granules" (manufactured by K.K. Tokuyama Siltex);

Zeolite: "Zeobuilder" (4A-type, manufactured by Zeobuilder);

Soap: A neutralized mixture of LUNAC L-98 (manufactured by Kao Corporation), LUNAC MY-98 (manufactured by Kao Corporation), and LUNAC P-95 (manufactured by Kao Corporation); mixing ratio, in terms of pure fatty acid components, being 40% by weight, 10% by weight, and 50% by weight;

Sodium Carbonate: Dense soda ash (manufactured by Central Glass Co., Ltd.);

Sodium Sulfate: Anhydrous neutral sodium sulfate (manufactured by Shikoku Kasei K.K.);

Sodium Polyacrylate: weight-average molecular weight: 15,000; measurement by GPC, calculated as polyethylene glycol;

Enzymes: "Cellulase K" (disclosed in JP-A-Sho 63-264699), "Kannase 24TK" (manufactured by Novo), and "Savinase 6.0T" (manufactured by Novo) in a weight ratio of 3:1:2;

Fluorescent Agent 1: "Tinopal CBS-X" (manufactured by Ciba Specialty Chemicals);

Fluorescent Agent 2: "Tinopal AMS-GX" (manufactured by Ciba Specialty Chemicals); and PVP/VA Polymer: PVP/VA copolymer "I-335" manufactured by International Specialty Products (weight-average molecular weight: 14,000, PVP/VA=30/70 molar ratio, Tg: 71° C.).

Evaluation of Redeposition Preventing Ability

<Method of Preparing Treated Cloths>

The treatment to the test cloths was carried out by subjecting test cloths to a 5-time cumulative washing treatment using a standard course in a fully automatic washing machine using a laundry detergent (NEWBEADS) at a concentration of 0.083% by weight. The cloths that were dried and moisture-controlled for an entire day in a thermostatic chamber (25° C. and 40% RH) were used as the treated cloths. The sizes of the test cloths were respectively 4 cm×5 cm. Here, the bath treatment conditions were a standard course (15 minutes of washing, rinsing twice, 5 minutes of spin-drying, and 15 L of water level) using a fully automatic washing machine Model JW-Z20A manufactured by Haier K.K., a water temperature of 20° C., and a liquor ratio of 40.

<Test Cloths>

Cotton knit (unstained with a fluorescent agent) and T/C broadcloth (mercerized with fluorescent agent stains) were obtained from K.K. Tanigashira Shoten TEL 06-6328-6134.

<Test Method for Redeposition Preventing Ability>

The redeposition preventing effect was evaluated using a round-O-meter. Each of detergent compositions of Tables 1 and 2 was dissolved in 100 mL hard water containing 72 mg/L calcium (calculated as $CaCO_3$), and adjusted so as to have a concentration of 0.15%. Next, 0.13 g of carbon, or 2.5 g of sludge (Kanuma red clay for gardening, having a size of 200 mesh-sieve passed [purchased from K.K. Kokukoen (10, Yoshimasa-cho, Izumi-shi, Osaka)]) was placed in a bath solution, and the mixture was subjected to ultrasonic irradiation for 15 minutes using a bathtub of an ultrasonic oscillator (Model "U0600PB-Y" manufactured by K.K. Kokusai Denki Eltech) and dispersed, and the dispersion was transferred to a glass cup for a round-O-meter.

Two kinds of treated cloths, having sizes of 4 cm×5 cm, 5 pieces per set for each kind, totaling 20 pieces, were each introduced into a bathing solution within the cup, and washed with a round-O-meter at 25° C., for 30 minutes, and a rotation speed of a pot of 40±2 r/min. After the washed cloths were rinsed with 5 L of tap water vesseled, the rinsed cloths were treated with an iron press. Next, the reflectance of the original cloth and the redeposition test cloth at 550 nm was determined with a spectrophotometer SE2000 manufactured by Nippon Denshoku Kogyo K.K., and the redeposition preventing percentage (%) was calculated from the following formula. The results are shown in Tables 1 and 2.

Formula:

$$\text{Redeposition Preventing Percentage (\%)} = \frac{\text{(Reflectance after Washing)}}{\text{(Reflectance of Original Cloth)}} \times 100$$

<Results>

As shown in Table 1, the detergent compositions of Examples 1 to 7 have proper compositional formulations based on the present invention, so that the effects by the surfactant and the clay mineral are exhibited. With regard to any of fine hydrophobic particles such as carbon and fine hydrophilic particles such as sludge, a significantly high redeposition preventing ability is realized, as compared to those of Comparative Examples 1 to 5. Further, since the detergent composition contains a proper fluorescent agent and a PVP/VA copolymer, a highly excellent redeposition preventing ability is realized.

As shown in Table 2, the detergent compositions of Examples 8 to 10 have proper compositional formulations based on the present invention, so that the effects by the surfactant and the clay mineral are also exhibited with regard to the redeposition against cloth containing synthetic of any of fine hydrophobic particles such as carbon and fine hydrophilic particles such as sludge. Further, since the detergent composition contains a proper fluorescent agent and a PVP/VA copolymer, a highly excellent redeposition preventing ability is realized.

Example 11

The following raw materials were used in Example 11.

Sodium Sulfate: Anhydrous neutral sodium sulfate (manufactured by Shikoku Kasei K.K.);

Sodium Sulfite: Sodium sulfite (manufactured by MITSUI CHEMICALS, INC.);

Fluorescent Agent: TINOPAL CBS-X (manufactured by Ciba Specialty Chemicals);

Sodium Carbonate: Dense soda ash (average particle size: 290 μm, manufactured by Central Glass Co., Ltd.);

40% by weight Aqueous Sodium Polyacrylate Solution: weight-average molecular weight: 10,000 (manufactured by Kao Corporation);

Sodium Chloride: Nakuru N (manufactured by Nankai Engyo K.K.);

Na-Bentonite Powder (Clay Mineral): manufactured by Süd-Chemie, product name: Laundrosil DGA powder, average particle size: 20 μm, Na/Ca weight ratio: 2.7;

Crystalline sodium aluminosilicate (zeolite): "Zeobuilder" (4A-type, average particle size: 3.5 μm), manufactured by Zeobuilder;

Crystalline Silicate: "Prefeed 6N" (manufactured by K.K. Tokuyama Siltex) powders (average particle size: 10 μm);

Polyoxyethylene Alkyl Ether (Nonionic Surfactant): EMULGEN 106KH1 (average number of moles of ethylene oxide: 6, the number of carbon atoms of alkyl moiety: 12-14);

Polyethylene Glycol: PEG13000 (weight-average molecular weight: 10,000, manufactured by Mitsui Chemical K.K.);

Dodecylbenzenesulfonic Acid (LAS-S): NEOPELEX GS (manufactured by Kao Corporation);

Fatty Acids: A blend of 38% by weight of LUNAC L-98 (manufactured by Kao Corporation), 12% by weight of LUNAC MY-98 (manufactured by Kao Corporation), and 50% by weight of LUNAC P-95 (manufactured by Kao Corporation); and Na-Bentonite Clay Granules: manufactured by Süd-Chemie, product name: Laundrosil DGA, Na/Ca weight ratio: 2.7, and Na content: 2.7% by weight.

Preparation of Base Granules for Absorbing Surfactant

A mixing vessel was charged with 375 kg of water, and after the water temperature reached 50° C., 182 kg of sodium sulfate, 5 kg of sodium sulfite, and 1 kg of a fluorescent agent was added thereto, while stirring the mixture for 10 minutes. Thereto were added 167 kg of sodium carbonate and 75 kg of a 40% by weight aqueous sodium polyacrylate solution. After stirring the mixture for 10 minutes, 30 kg of sodium chloride was added thereto, while stirring the mixture for 10 minutes. Further, 160 kg of zeolite was added thereto, and stirred for 30 minutes, to give a homogeneous slurry. The final temperature of this slurry was 53° C. This slurry was fed with a pump to a spray-drying tower (countercurrent type), and the slurry was sprayed at a spraying pressure of 2.5 MPa from a pressure spray nozzle set near the top of the tower. A high-temperature gas introduced into a spray-drying tower was fed at a temperature of 200° C. from the bottom of the tower, and discharged at 90° C. from the top of the tower. The resulting spray-dried granules were used as base granules for absorbing a surfactant (detergent base granules). The base granules for absorbing a surfactant had a water content of 2%. Here, the content of the granules is determined by a method prescribed in JIS K 0068.

Preparation (1) of Detergent Granules

A ribbon mixer (manufactured by Hosokawa Micron Corporation, volume: 200 L, equipped with a jacket) was charged with 86.7 kg of base granules for absorbing a surfactant and 5.5 kg of a clay mineral of Na-bentonite powder, and the contents were stirred for 2 minutes (agitation blades, rotation speed: 60 rpm, peripheral speed: 1.6 m/s). Here, a hot water at 80° C. was allowed to flow through the jacket at a rate of 40 L/min. Thereto was introduced 41 kg of a surfactant composition (polyoxyethylene alkyl ether/polyethylene glycol/sodium dodecylbenzenesulfonate/water=24.7/1/20.7/6.1) in 4 minutes, and thereafter the mixture was stirred for 6 minutes, whereby a surfactant composition was absorbed to the base granules.

Next, the absorbed base granules were transferred to a High-Speed Mixer (manufactured by Fukae Powtec Corporation, volume: 455 L, equipped with a jacket), and 10 kg of zeolite (manufactured by Zeobuilder, 4A-type, average particle size: 3.5 μm) was introduced thereinto as a surface-modifying agent to carry out surface modification, while rotating the main shaft (rotational speed: 82 rpm) and the chopper (rotational speed: 1800 rpm), to give detergent granules. Here, a hot water at 70° C. was allowed to flow through the jacket at a rate of 60 L/min.

Thereafter, using a concrete mixer, 710 g of zeolite (manufactured by Zeobuilder, 4A-type, average particle size: 3.5 μm), 40 g of perfume, and 1.2 kg of Na-bentonite clay granules were blended based on 15 kg of the resulting detergent granules, to give a detergent composition.

Comparative Example 7

Preparation (2) of Detergent Granules

A detergent composition was obtained in the same manner as in Example 11 except that in Example 11 the amount of the Na-bentonite powder supplied was changed to 0 kg and the amount of the Na-bentonite clay granules was changed to 0 kg.

<Test method for Storage Stability>

An open-top box having dimensions of 10.2 cm in length, 6.2 cm in width, and 4 cm in height is made out of a filter paper (No. 2, manufactured by ADVANTEC) by stapling the filter paper at four corners. An acrylic resin plate (15 g) and a lead plate (250 g) are placed on the box charged with a 50 g sample (detergent composition). The box is allowed to stand in an atmosphere of a temperature of 30° C. and a humidity of 70%, and the caking state after 3 and 4 weeks is evaluated by calculating the sieve permeability as follows.

Sieve Permeability: A sample obtained after the test is gently placed on a sieve (sieve opening: 4760 μm, as defined by JIS Z 8801), and the weight of the powder passed through the sieve is measured. The sieve permeability (%) based on the sample obtained after the test is calculated.

Bleed-out Property: Bleed-out state of a detergent composition is visually examined at bottom (side not contacting with powder) of the vessel made of the filter paper after the sieve permeability test. The evaluation of the bleed-out property is made based on the area of wetted portion occupying the bottom in the following 1 to 5 ranks:

Rank 1: not wetted;
Rank 2: about ¼ of the bottom area being wetted;
Rank 3: about ½ of the bottom area being wetted;
Rank 4: about ¾ of the bottom area being wetted; and
Rank 5: the entire bottom area being wetted.

The storage stability of Example 11 and Comparative Example 7 is shown in Table 3.

TABLE 3

| | Ex. 11 | Comp. Ex. 7 |
|---|---|---|
| 21-Day Sieve Permeability | 99 | 62 |
| 21-Day Bleed-out Property | 3 | 4 |
| 28-Day Sieve Permeability | 90 | 41 |
| 29-Day Bleed-out Property | 3 | 5 |

<Results>

Example 11 is formulated within the range in which the desired effects for the powdery clay mineral and granular clay mineral (clay granules) can be expected. Therefore, as compared to Comparative Example 7 in which the effects of the clay mineral cannot be expected, Example 11 is more excellent in storage stability from both the aspects of sieve permeability and bleed-out property. In addition, when the bentonite clay granules used in Example 11 were measured by the method described above, the undissolved ratio was 0.6%.

The invention claimed is:

1. A detergent composition comprising:

(a) a nonionic surfactant comprising a polyoxyalkylene alkyl ether of which alkylene oxide moiety has an average number of moles of from 4 to 8;

(b) a surfactant system comprising an anionic surfactant, excluding a fatty acid and a salt thereof, and a cationic surfactant present in an amount of 2% by weight or less (c) a clay mineral represented by the general formula (I):

$$[Si_8(Mg_aAl_b)O_{20}(OH)_4]^{X-}\cdot Me^{X+} \quad (I)$$

wherein a, b and x satisfy $0<a\leqq 6$, $0<b\leqq 4$, and $x=12-2a-3b$, and Me is at least one member selected from Na, K, Li, Ca, Mg and $NH_4$, wherein the detergent composition comprises the clay mineral in an amount of 3% by weight or more, a weight ratio of a total amount of component (a) to the total amount of component (b), (a)/(b), exceeds 1 and is less than 5, a total amount of the nonionic surfactant (a) and anionic surfactant (b) in the detergent composition is from 10% by weight to 30% by weight, and the clay mineral (c) has a Na/Ca weight ratio of 1.0 or more.

2. The detergent composition according to claim 1, wherein the component (c) a clay mineral has a Na/Ca weight ratio of 2.0 or more.

3. The detergent composition according to claim 1, wherein all or a part of the component (c) is contained in the form of clay granules having an undissolved ratio as defined in the formula (II) of from 0.2 to 2.5%, under stirring conditions that 1 g of the clay granules are supplied to 1-liter of deionized water at 20° C. in a 1-liter beaker (inner diameter: 105 mm) and stirred with a stirring bar (length: 35 mm, and diameter: 8 mm) at a rotational speed of 800 rpm for 20 minutes, when filtered with a standard sieve (sieve opening: 74 μm) as prescribed in JIS Z 8801, wherein the undissolved ratio is calculated by the formula (II):

$$\text{undissolved ratio}(\%)=T/S\times 100 \quad (II)$$

wherein

S is a weight (g) of the clay granules supplied; and

T is a dry weight (g) of undissolved granules remaining on the sieve when an aqueous solution prepared under the above stirring conditions is filtered with the sieve, under drying conditions that the granules are kept at 105° C. for 1 hour, and thereafter kept in a desiccator containing silica gel at 25° C. for 30 minutes.

4. The detergent composition according to claim 1, further comprising a copolymer having a constituting unit derived from N-vinylpyrrolidone.

5. The detergent composition according to claim 1, wherein the detergent composition comprises the component (a) and the component (b) in a total amount of 10% by weight to 25% by weight.

6. The detergent composition according to claim 1, wherein the detergent composition comprises:

(A) detergent granules having a structure that the component (c) clay mineral is present on a surface of surfactant-containing granules comprising the component (a) and the component (b), and a side of a layer of the surface is further coated with a surface-modifying agent; and (B) clay granules comprising the component (c) clay mineral in an amount of 35% by weight or more.

7. The detergent composition according to claim 1, further comprising (d) a polyacrylic acid-based polymer having a weight-average molecular weight of from 5,000 or more and 100,000 or less.

8. The detergent composition according to claim 1, which is in the form of a powder.

9. The detergent composition according to claim 1, wherein the amount of clay mineral (c) is from 5% by weight to 25% by weight.

10. The detergent composition according to claim 1, wherein the weight ratio of (a)/(b) exceeds 1 and is less than 4.

11. The detergent composition according to claim 1, wherein a total amount of the nonionic surfactant (a) and anionic surfactant (b) in the detergent composition is from 15% by weight to 30% by weight.

12. The detergent composition according to claim 10, wherein the weight ratio of (a)/(b) exceeds 1.3 and less than 3.

13. The detergent composition according to claim 1, wherein the nonionic surfactant (a) has ethylene oxide (EO) with an average number of moles of 4.5 to 7.

14. The detergent composition according to claim 1, wherein said anionic surfactant (b) is a linear alkylbenzenesulfonate or an alkyl sulfuric ester salt thereof.

* * * * *